US006047504A

United States Patent [19]

Dusenberry

[11] Patent Number: 6,047,504

[45] Date of Patent: Apr. 11, 2000

[54] CONNECTOR PLATE FOR LUMBER

[76] Inventor: Charles Dusenberry, 11919 Meadows Rd., White City, Oreg. 97503

[21] Appl. No.: 09/067,326

[22] Filed: Apr. 27, 1998

[51] Int. Cl.[7] ..... E04B 7/04; E04B 1/21

[52] U.S. Cl. ..... 52/92.2; 52/93.2; 52/514; 52/632; 52/645; 52/703; 52/713

[58] Field of Search ..... 52/92.2, 93.2, 52/514, 632, 645, 703, 713

[56] References Cited

U.S. PATENT DOCUMENTS

| | | | |
|---|---|---|---|
| 2,827,676 | 3/1958 | Sanford . | |
| 2,937,418 | 5/1960 | Sanford . | |
| 3,312,485 | 4/1967 | Koenigshof . | |
| 3,596,941 | 8/1971 | Terry . | |
| 3,861,104 | 1/1975 | Bower | 52/713 X |
| 4,682,460 | 7/1987 | Reetz . | |
| 4,713,923 | 12/1987 | Sielaff et al. | 52/92.2 X |
| 4,932,173 | 6/1990 | Commins . | |
| 5,303,520 | 4/1994 | Gozdziak | 52/713 X |
| 5,357,721 | 10/1994 | Alvarez | 52/93.2 X |

*Primary Examiner*—Christopher T. Kent
*Attorney, Agent, or Firm*—James D. Givnan, Jr.

[57] ABSTRACT

A connector plate for joining, in a biased manner, structural members of a building and including first and second plates in overlapped relationship with each plate adapted for individual securement to a structural member being joined. A tapered insert serves to impart tension to at least one of the plates so as to draw the attached structural member toward the remaining member. Supplemental tensioning members engage misaligned openings in the plates to further tension one of the plates.

6 Claims, 2 Drawing Sheets

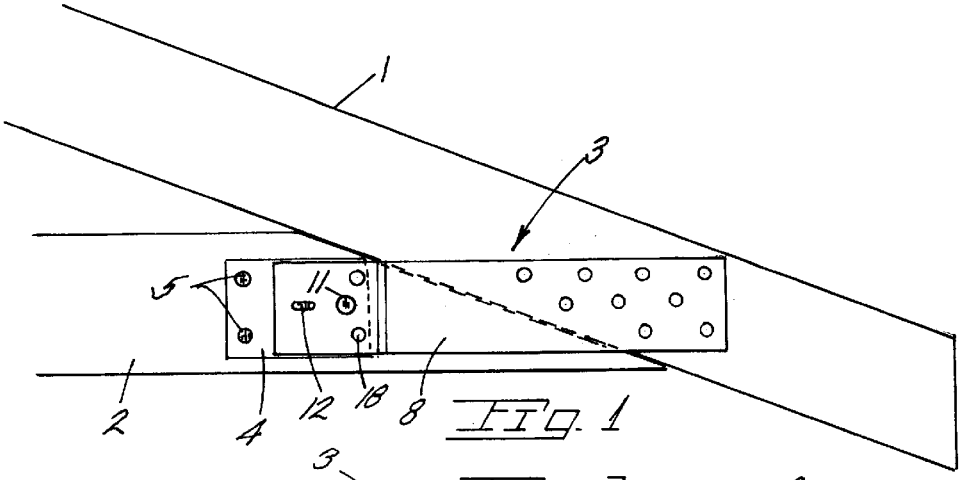
FIG. 1
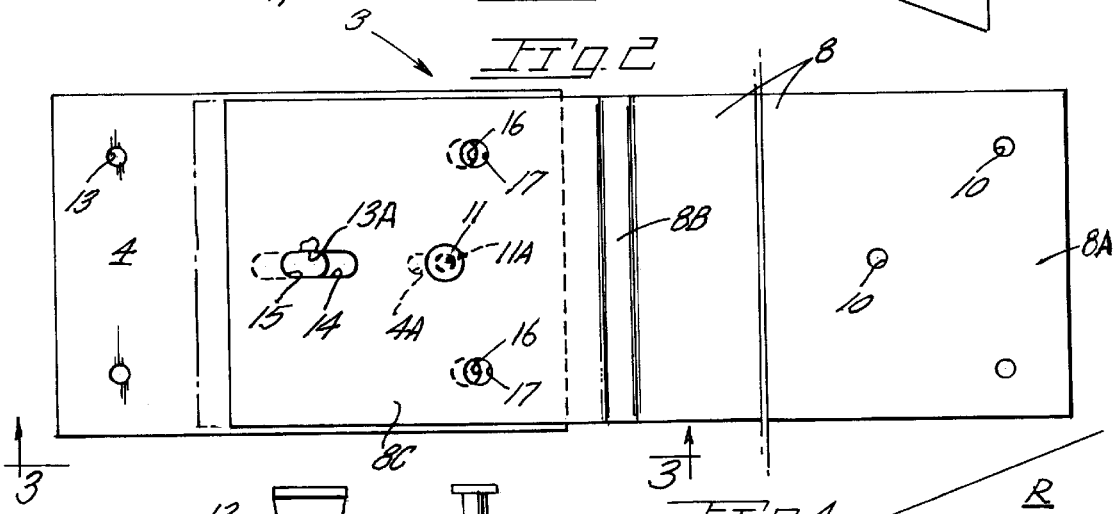
FIG. 2
FIG. 4
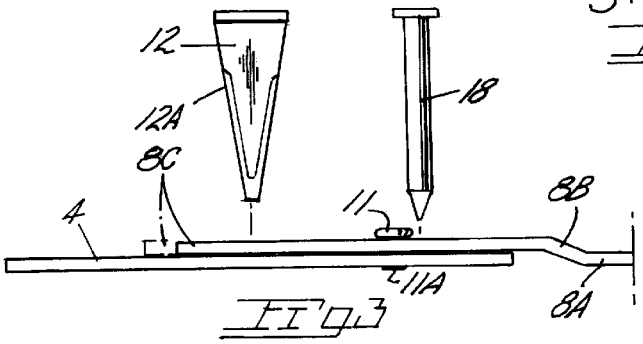
FIG. 3
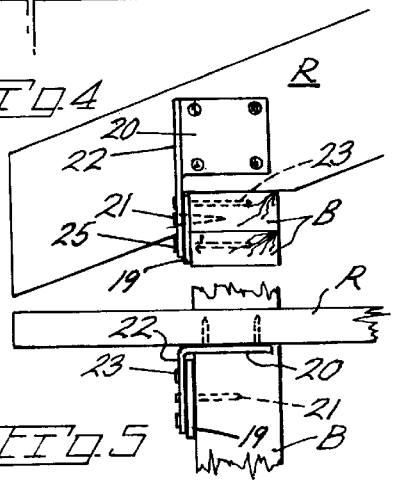
FIG. 5

CONNECTOR PLATE FOR LUMBER

BACKGROUND OF THE INVENTION

The present invention pertains generally to devices for connecting structural components of a building.

A wide variety of connectors are presently available for use in the building trades for joining structural components of a structure, such as for example, rafters and trusses to top plates and floor joists to floor girders.

It is desirable that no gaps exist or develop in time between the building components, over a period of time. Due to shrinkage of lumber components in a building a gap may occur therebetween. Such gapping is often encountered in the remodeling of older structures of wooden construction. To the extent known, conventional connector plates and the like do not make provision for imparting oppositely directed forces across opposing surfaces of two prior to securement to one another.

U.S. Pat. No. 4,682,460 discloses an adjustable spacer apparatus located intermediate a supporting wall and a chord member of an open web structure or truss for accommodating such structures of irregular lengths.

U.S. Pat. Nos. 2,937,418 and 2,827,676 disclose an elongate, toothed connector plate both nailed and pressed into chord member engagement, U.S. Pat. No. 3,312,485 shows a gusset for a truss formed with "pins" to actuate the trigger of a nailing gun.

U.S. Pat. No. 3,596,941 shows the use of a bracket for rafters and formed with openings to aid the user in maintaining uniform pitch in a roof under construction.

U.S. Pat. No. 4,932,173 discloses a connector plate shaped to provide secure attachment of truss chords to a top plate of a building wall.

SUMMARY OF THE PRESENT INVENTION

The present invention is directed toward the use of a connector plate which applies tension along the connector plate axis for the purpose of drawing building components toward one another.

The present connector plate includes cooperating plates each of which is attached to a structural component to be joined. An actuator thereafter puts the plates in tension. A surface on the actuator serves as a cam to impart movement to a connector plate during insertion of the actuator. In instances where the gapping between components is excessive, a shim may be utilized to achieve abutting contact between the components.

The drawing of the building components into abutment precludes the later risk of buckling a connector plate when subjected to a compression load possible when a gap exists between structural members. Additionally of benefit to the integrity of the assembled wood structure is the application of the present connector plate in tension to diminish the likelihood of a gap forming between joined components.

BRIEF DESCRIPTION OF THE DRAWINGS

In the accompanying drawings:

FIG. 1 is an elevational view of structural components joined by the present connector;

FIG. 2 is an enlarged elevational view of the present connector;

FIG. 3 is a view taken along line 3—3 of FIG. 2;

FIGS. 4 and 5 are elevational and plan views of a connector embodying the present invention suited for joining a rafter to a top plate of a building structure;

DETAILED DESCRIPTION OF THE PREFERRED EMBODIMENTS

Figure 6:
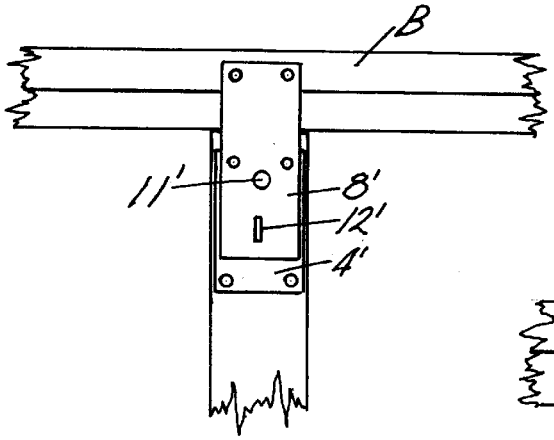
FIGS. 6, 7 and 8 are elevational views of modified connectors.

With continuing attention to the drawings wherein applied reference numerals indicate parts similarly hereinafter identified, the reference numeral 1 indicates a building component which may be a chord of a truss with a bottom chord at 2. The present connector is indicated generally at 3 in place on the truss but having other applications.

The present connector includes a base plate 4 for securement as by nailing at 5 to a building component such as a chord of a truss. Base plate 4 defines openings 13 for reception of nails with a second set of openings at 14 for additional nailing as later explained.

A tensional plate at 8 is elongate and provided with a number of nail receiving openings 10 for plate attachment to upper chord 1 or other building components. An end segment 3A of plate 8 is somewhat offset by a Z-shaped mid portion at 8B as best shown in FIG. 3. A remaining end segment 8C at least partially overlaps base plate 4. A rivet at 11 passes through both plates to couple them and permits relative movement in one direction therebetween. An elongate opening 4A in the base plate receives the shank at 11A and allows lateral displacment of the rivet during installation of the plate as later explained.

Misaligned elongate openings 13 and 14 in base plate 4 and tensional plate 8 enable relative movement to be imparted between base plate 4 and tensional plate 8 by an actuator at 12. A cam surface 12A on the actuator acting on an opening edge at 15 displaces tensional plate 8, to the left in FIG. 2, to the broken line position simultaneously imparting like movement to end segment 8A of the tensional plate. Accordingly with said end segment secured in place on upper chord 1 any modest gap between the chords is closed. For remedying gaps of greater size, a shim may be inserted between the chords prior to insertion of actuator 12.

To supplement the drawing action of actuator 12 on tensional plate 8 as above described, base plate openings at 16 are provided with which tensional plate openings at 17 are partially registered as shown in FIG. 2 to the extent the points of nails at 18 may be inserted therepast and started into the chord. The shank of each nail 18 closely corresponds in section to the area of each of the partially registered openings to supplement the drawing action of actuator 12 in applying a tension load to plate 8.

In FIGS. 4 and 5, I show a modified connector particularly suited for attachment to a rafter as at R and to top plate boards as at B. A base plate is at 19 while a tensional plate is at 20. An actuator is at 21 with the plates slidably joined as by a rivet 25 with an elongate slot (not shown) in base plate 19 all as earlier described with reference to the preferred form of the invention. Tensional plate 20 includes a right angular flange 22 which depends from the tensional plate proper. The flange is apertured to receive nails or other fasteners at 23 one in each of the top plate boards. Upon seating of actuator 21 and supplemental nails at 23, plate 20 is put under a tension load to close or at lease reduce gapping intermediate rafter R and top plate B.

Figure 7:
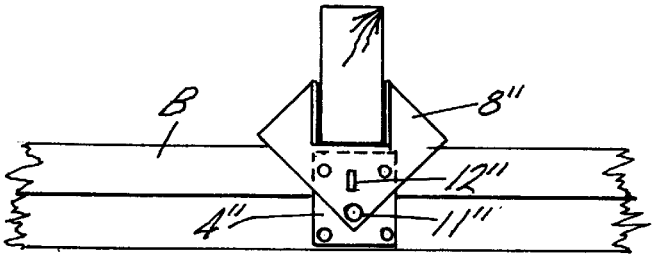
Figure 8:
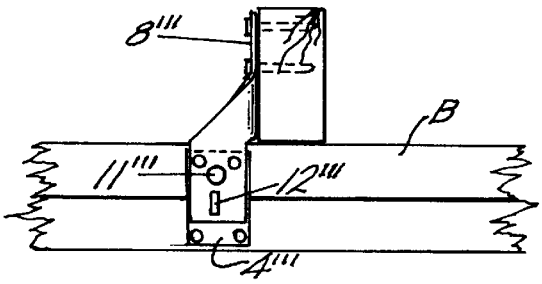

In FIGS. 6, 7 and 8, different modified forms of the connector plate are shown wherein connector base plates are at 4', 4" and 4'" and include features of the earlier described base plates. Tensional plates are at 8', 8" and 8'". Additional parts of the modified connectors are also identified with reference numerals corresponding to the parts identified by earlier prime reference numerals.

In use, the connector base plates are preferably secured to the top plates of a wall structure for optimum strength.

While the present connector is shown attached to building components by nails it will be understood that, in some instances, where plate strength is not jeopardized, prongs may be punched from one or both plates for attachment purposes. The foregoing applies to nails utilized solely for plate attachment and does not include nails at 16 which additionally serve to impart tension to tensional plate 8.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A connector plate for joining components of a structure and comprising, first and second plates at least in partially overlying relationship, means for separately attaching said plates to adjacent components of the structure, and actuating means engageable with said plates for biasing said plates and their attached respective components in opposite directions toward one another.

2. The connector plate claimed in claim 1 wherein one of said plates is of Z shape in lengthwise section and additionally including coupling means for joining said plates in an adjustable manner.

3. The connector plate claimed in claim 1 wherein said actuating means for biasing said plates includes an elongate insert having at least one elongate edge inclined to the major axis of the insert.

4. The connector plate claimed in claim 3 wherein said plates each jointly define openings in partial mutual registration subsequent installation respectively on the plates on components of the structure.

5. The connector plate claimed in claim 4 wherein said insert is of greater cross section than the area of partial mutual registration defined by the plates.

6. The connector plate claimed in claim 1 wherein one of said plates includes a right angular flange for securement to one of said components.

* * * * *